US010876552B2

(12) United States Patent
Kutre

(10) Patent No.: US 10,876,552 B2
(45) Date of Patent: Dec. 29, 2020

(54) HYDRAULIC FLUID PRESSURE COMPENSATOR UNIT WITH INTEGRATED LOAD SENSE AND REVERSE FLOW CHECKS

(71) Applicant: EATON INTELLIGENT POWER LIMITED, Dublin (IE)

(72) Inventor: Manohar S. Kutre, Pune (IN)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 16/573,048

(22) Filed: Sep. 17, 2019

(65) Prior Publication Data

US 2020/0096022 A1 Mar. 26, 2020

(30) Foreign Application Priority Data

Sep. 21, 2018 (IN) ..... 201811035591

(51) Int. Cl.
*F15B 21/00* (2006.01)
*F15B 11/02* (2006.01)
*F15B 11/16* (2006.01)

(52) U.S. Cl.
CPC ..... *F15B 21/006* (2013.01); *F15B 11/02* (2013.01); *F15B 11/16* (2013.01)

(58) Field of Classification Search
CPC .... F15B 21/006; F15B 13/0417; F15B 11/05; F15B 13/027; F15B 2211/3054; F15B 2211/6052
See application file for complete search history.

(56) References Cited

U.S. PATENT DOCUMENTS 3,881,512 A * 5/1975 Wilke ..... F15B 13/0402 137/596.13
4,617,798 A * 10/1986 Krusche ..... F15B 11/165 137/625.68
5,038,671 A * 8/1991 Ueno ..... F15B 13/0417 137/596.13
6,457,487 B1 * 10/2002 Stephenson ..... F15B 11/042 137/596.16
7,063,100 B2 6/2006 Liberfarb
8,464,757 B2 * 6/2013 Rub ..... F15B 13/0417 137/625.69
8,671,824 B2 * 3/2014 Kauss ..... F15B 11/024 91/421
2014/0251470 A1 9/2014 Bissbort et al.
2018/0112686 A1 * 4/2018 Roberti ..... E02F 9/2267

* cited by examiner

*Primary Examiner* — Thomas E Lazo
(74) *Attorney, Agent, or Firm* — Merchant & Gould P.C.

(57) ABSTRACT

Hydraulic pressure compensator units and hydraulic systems incorporating hydraulic pressure compensator units. The pressure compensator units include a main valve body defining a central axis and a first central passage, a compensation valve member positioned in the first central passage and defining a second central passage, the first central passage being in selective fluid communication with a port of hydraulic actuator. A load sense check component is positioned within the second central passage and adapted to move in a first axial direction to selectively open a fluid communication between a pump output and a load sense line. A reverse flow check component is positioned within the second central passage and adapted to move in a second axial direction opposite the first axial direction to selectively open a fluid communication between the hydraulic actuator and a tank line.

26 Claims, 8 Drawing Sheets

HYDRAULIC FLUID PRESSURE COMPENSATOR UNIT WITH INTEGRATED LOAD SENSE AND REVERSE FLOW CHECKS

This application claims benefit of Serial No. 201811035591, filed 21 Sep. 2018 in India, the disclosure of which is incorporated herein by reference in its entirety. To the extent appropriate, a claim of priority is made to the above disclosed application.

TECHNICAL FIELD

The present disclosure relates generally to, but is not limited to, using load sensing to perform hydraulic fluid flow and pressure compensation in variable displacement or fixed displacement hydraulic systems.

BACKGROUND

Many hydraulic systems use a variable displacement pump to pump hydraulic fluid through the system in response to control commands for handling a load. The pump includes a swash plate that dictates the amount of pump pressure provided by the pump to an actuator, e.g., a hydraulic cylinder that performs work on a load. To conserve energy, prevent damage to the system (e.g., if the load is too great for the system to handle), etc., the hydraulic system has load compensation features used to control the flow and the pressure in the system so that only the required flow at the required pressure is generated in response to given operating conditions. Compensator components are linked, via a compensation valve, to a pump control that controls the position of the swash plate, allowing for selective stroking and de-stroking of the pump as the operating conditions dictate. Thus, for example, when the system is being actuated, the compensator enables the pump to sense and respond to the varying pressure requirements of the hydraulic system, which pressure will vary as the load on the actuator changes. By dynamically adjusting hydraulic flow and pressure according to a sensed load, the system is able to adjust performance of the pump for maximum efficiency.

In a typical compensator system, load sensing outputs from the compensator system are controlled by components (e.g., valves, flow checks) that are separate and distinct from the compensator units themselves, complicating installation and repair, and increasing the size and overall complexity of the hydraulic system. There is a need for more compact compensator units and subsystems of hydraulic systems.

The contents of U.S. Pat. No. 7,063,100 and U.S. Patent Publication No. 2014/0251470 are hereby incorporated by reference in their entireties.

SUMMARY

In general terms, the present disclosure is directed to hydraulic systems with compact pressure compensator units that provide load sensing and compensating capabilities for controlling a hydraulic load, as well as reverse flow capabilities. The present disclosure is also directed to compact pressure compensator units that can be installed and used in such hydraulic systems. The hydraulic systems are not limited to any particular application or applications. Non-limiting hydraulic systems in which principles of present disclosure may be employed include, for example, hydraulic equipment such as a mobile crane, a backhoe or other loader, an excavator, a drill, a tractor, a telehandler, etc.

According to certain aspects of the present disclosure, a multi-functional valve unit comprises: a valve arrangement configured to be installed in a valve block as a unit, the valve arrangement being configured to permit fluid flow in a forward direction through the valve arrangement from a first location to a second location, the valve arrangement also being configured to permit fluid to flow in a reverse direction through the valve arrangement from the second location to the first location, the valve arrangement including: a pressure compensated flow control valve configured to maintain a constant pressure drop with respect to fluid flowing in the forward direction through the valve arrangement, wherein fluid is prevented from flowing through the pressure compensated flow control valve in the reverse direction through the valve arrangement; a reverse flow check valve positioned along a flow path that bypasses the pressure compensated flow control valve, the reverse flow check valve being configured to allow fluid flowing in the reverse direction through the valve arrangement to flow through the flow path and bypass the pressure compensated flow control valve, and the reverse flow check valve being configured to prevent fluid flowing in the forward direction through the valve arrangement to bypass the pressure compensated flow control valve through the flow path; and a load sense check valve in fluid communication with the second location, wherein the load sense check valve opens when fluid flows in a forward direction through the valve arrangement.

According to further aspects of the present disclosure, a hydraulic pressure compensator unit comprises: a main valve body defining a central axis and a first central passage; a compensation valve member positioned in the first central passage and defining a second central passage, a first opening defined by the main valve body adapted to be in selective fluid communication with a port of a hydraulic actuator via a second opening defined by the main valve body; a load sense check component positioned within the second central passage and adapted to move axially relative to the compensation valve member between a load sense open position and a load sense closed position, the load sense open position being in a first axial direction away from the load sense closed position, wherein in the load sense open position the first opening is adapted to be in fluid communication with a load sense line via a third opening defined by the main valve body, and wherein in the load sense closed position the first opening is adapted to be blocked from fluid communication with the load sense line; and a reverse flow check component positioned within the second central passage and adapted to move axially relative to the compensation valve member between a reverse flow open position and a reverse flow closed position, the reverse flow open position being in a second axial direction away from the reverse flow closed position, the second axial direction being opposite the first axial direction, wherein in the reverse flow open position the second opening is adapted to be in fluid communication with a tank line via the first opening, and wherein in the reverse flow closed position the second opening is adapted to be blocked from fluid communication with the tank line.

According to further aspects of the present disclosure, a hydraulic system comprises: a hydraulic actuator; a variable displacement pump in selective fluid communication with a first port of the hydraulic actuator and in selective fluid communication with a second port of the hydraulic actuator; a load sense line; a tank line; a pump adjustment system; a pump control operatively coupled to the pump adjustment system and a swash plate of the pump; and first and second hydraulic pressure compensator units, each of the compensator units comprising: a main valve body defining a central axis and a first central passage; a compensation valve member positioned in the first central passage and defining a second central passage, a first opening defined by the main valve body adapted to be in selective fluid communication with one of the first and second ports of the hydraulic actuator via a second opening defined by the main valve body to selectively provide pump pressure to the first or second port of the hydraulic actuator; a load sense check component positioned within the second central passage and adapted to move axially relative to the compensation valve member between a load sense open position and a load sense closed position, the load sense open position being in a first axial direction away from the load sense closed position, wherein in the load sense open position the first opening is adapted to be in fluid communication with the load sense line via a third opening defined by the main valve body to provide pump pressure to the load sense line, and wherein in the load sense closed position the first opening is adapted to be blocked from fluid communication with the load sense line; and a reverse flow check component positioned within the second central passage and adapted to move axially relative to the compensation valve member between a reverse flow open position and a reverse flow closed position, the reverse flow open position being in a second axial direction away from the reverse flow closed position, the second axial direction being opposite the first axial direction, wherein in the reverse flow open position, the second opening is adapted to be in fluid communication with the tank line via the first opening, and wherein in the reverse flow closed position the second opening is adapted to be blocked from fluid communication with the tank line.

A variety of additional aspects will be set forth in the description that follows. The aspects can relate to individual features and to combinations of features. It is to be understood that both the forgoing general description and the following detailed description are exemplary and explanatory only and are not restrictive of the broad concepts upon which the examples disclosed herein are based.

BRIEF DESCRIPTION OF THE DRAWINGS

The accompanying drawings, which are incorporated in and constitute a part of the description, illustrate several aspects of the present disclosure. A brief description of the drawings is as follows.

DETAILED DESCRIPTION

Figure 1:
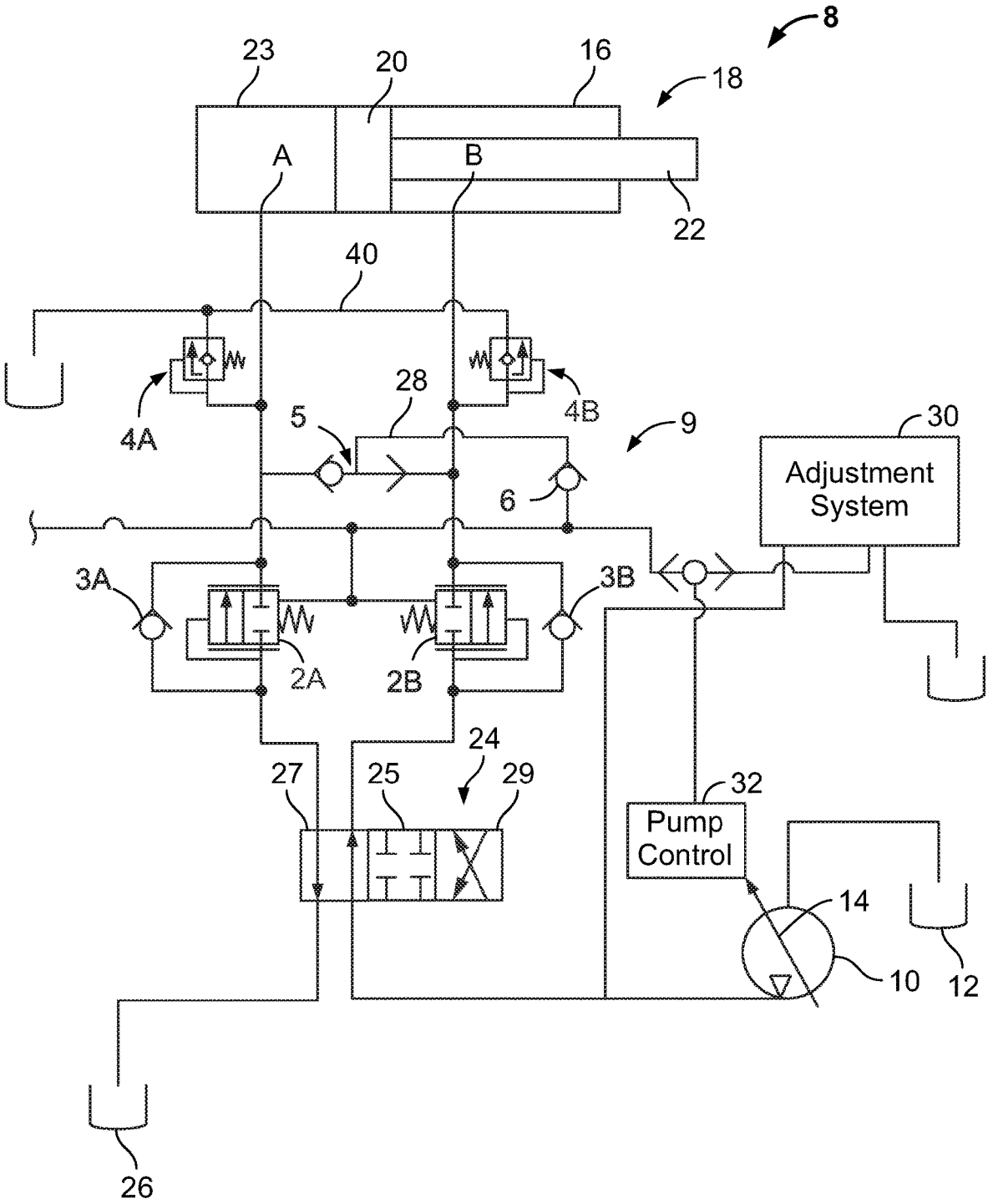
Fig. 1 PRIOR ART
FIG. 1 schematically illustrates a prior art hydraulic system including a prior art hydraulic compensator arrangement.

A typical prior art hydraulic compensator arrangement 9 is schematically depicted in FIG. 1 in a hydraulic system 8. A variable displacement pump 10 is in fluid communication with a tank 12, includes a swash plate 14, and is adapted to charge a hydraulic actuator 16 via first and second actuator ports A and B. In this example, the hydraulic actuator 16 is a cylinder and includes a piston 18 having a piston head 20 and a piston shaft 22. The piston shaft 22 moves axially within a cylinder body 23.

As used herein, two locations are in fluid communication if a fluid pathway through one or more fluid conduits exists between the two locations and any valves or other fluid flow checks positioned along the pathway are at least partially open. If at least one valve or other fluid flow check along the pathway is closed, the two locations are not in fluid communication, even if there is incidental fluid leakage through the valve or other fluid flow check.

A three position closed-center valve 24 (e.g., a three-position spool valve; and alternatively, any configuration of a directional control spool valve) determines which of the actuator ports A, B is in fluid communication with the pump 10, and which is in fluid communication with tank 26. In the depicted position of the valve 24, the port B is on the high pressure side of the cylinder 16 and is in fluid communication with the pump 10, and the port A is on the low pressure side of the cylinder 16 and is in fluid communication with tank 26. When the three-position valve is in the righthand position 29, the port A is on the high pressure side of the cylinder 16 and is in fluid communication with the pump 10, and the port B is on the low pressure side of the cylinder 16 and is in fluid communication with tank 26. When the three-position valve 24 is in the center position 25, the ports of the three-position valve 24 are blocked such that the cylinder ports A, B as well as the valve ports of the valve 24 are not in fluid communication with (i.e., are blocked from fluid communication with) either the pump 10 or tank 26. Each of the ports A, B is in fluid communication with a corresponding relief valve 4A, 4B, which selectively opens and closes to a pressure relief line 40. In the event of an overload condition when, e.g., the three-position valve 24 is in the center position 25, pressure in the actuator 16 can be relieved via the appropriate relief valve 4A, 4B.

The compensator arrangement 9 is adapted to sense a load on the actuator 16 and provide a load sense signal to a pump adjustment system 30 corresponding to the sensed load. The response of the adjustment system 30 to the load sense signal controls the position of the swash plate 14 via a pump control 32. The response of the adjustment system 30 to the load sense signal can, e.g., cause the swash plate 14 to move to either stroke or de-stroke the pump to meet the pressure and flow requirements of the load at a given time and state of the system, thereby improving the overall efficiency of the system, e.g., by minimizing needless stroking of the pump, which wastes energy.

The compensator arrangement 9 is set up such that each port A, B of the actuator 16 has a designated pressure compensation valve 2A, 2B, respectively. To provide accurate load sensing to the adjustment system 30 via the load sense line 28, only one of the pressure compensation valves 2A, 2B can be open to the load sense line 28 at a time. To fluidly isolate the pressure compensation valves 2A, 2B from each other with respect to the load sense line 28, a shuttle valve 5 is provided. The shuttle valve 5 is thus shared by the two pressure compensation valves 2A, 2B, with each of the pressure compensation valves 2A, 2B being in selective fluid communication with the load sense line via the shuttle valve 5 one at a time. In addition, and because the shuttle valve 5 is shared as just described, a reverse flow check 6 is needed and provided to prevent reverse fluid flow from the actuator 16 to the return line or tank 26.

Reverse flow checks 3A and 3B are also provided for each pressure compensation valve 2A, 2B respectively, preventing charging flow from the pump 10 from bypassing the pressure compensation valve 2A, 2B, while permitting a bypass of the pressure compensation valve 2A, 2B when fluid is draining from the corresponding port 2A, 2B to tank 26.

Figure 2:
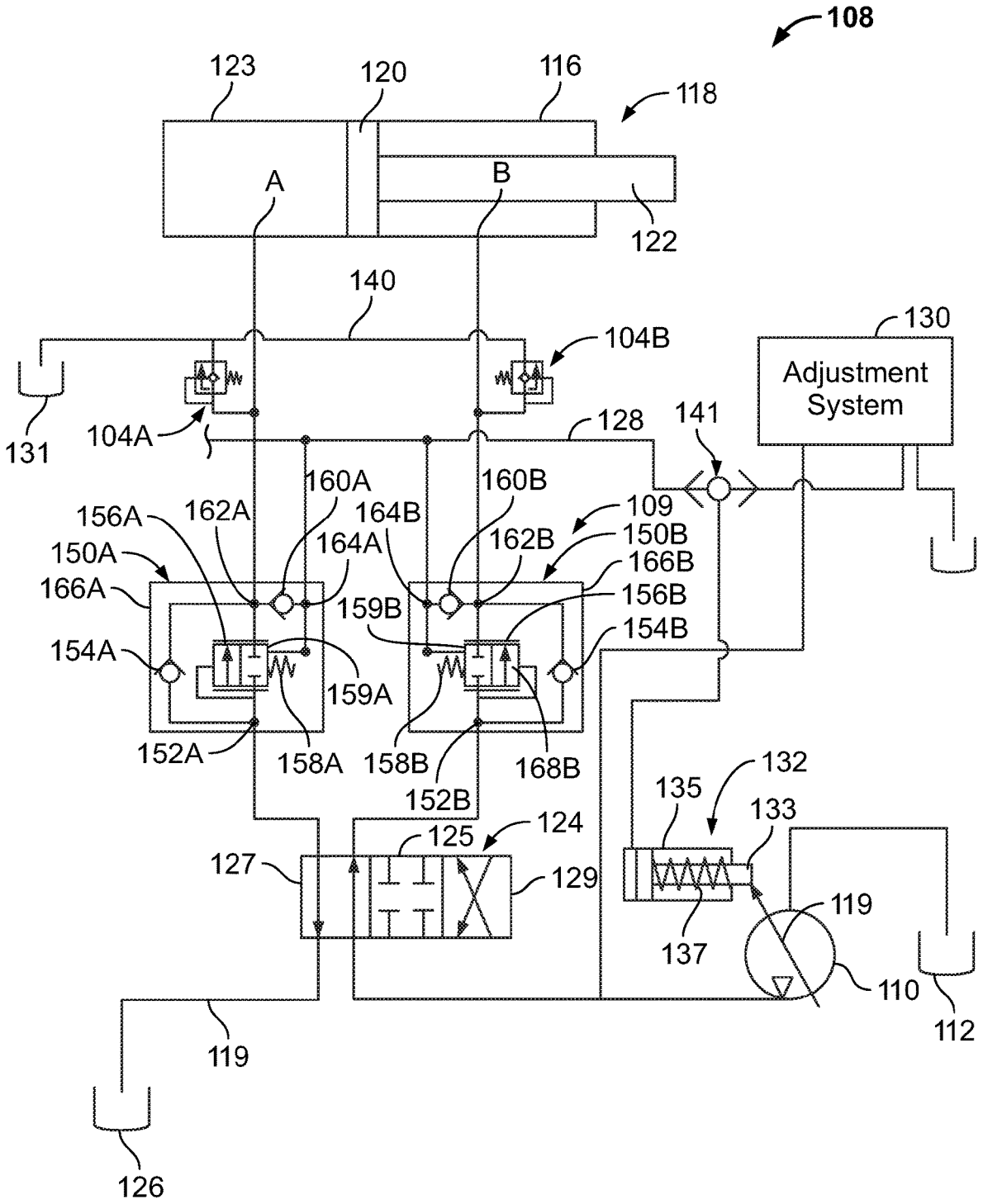
FIG. 2 schematically illustrates a hydraulic system according to the present disclosure, the hydraulic system including pressure compensator units according to the present disclosure.
Figure 3:
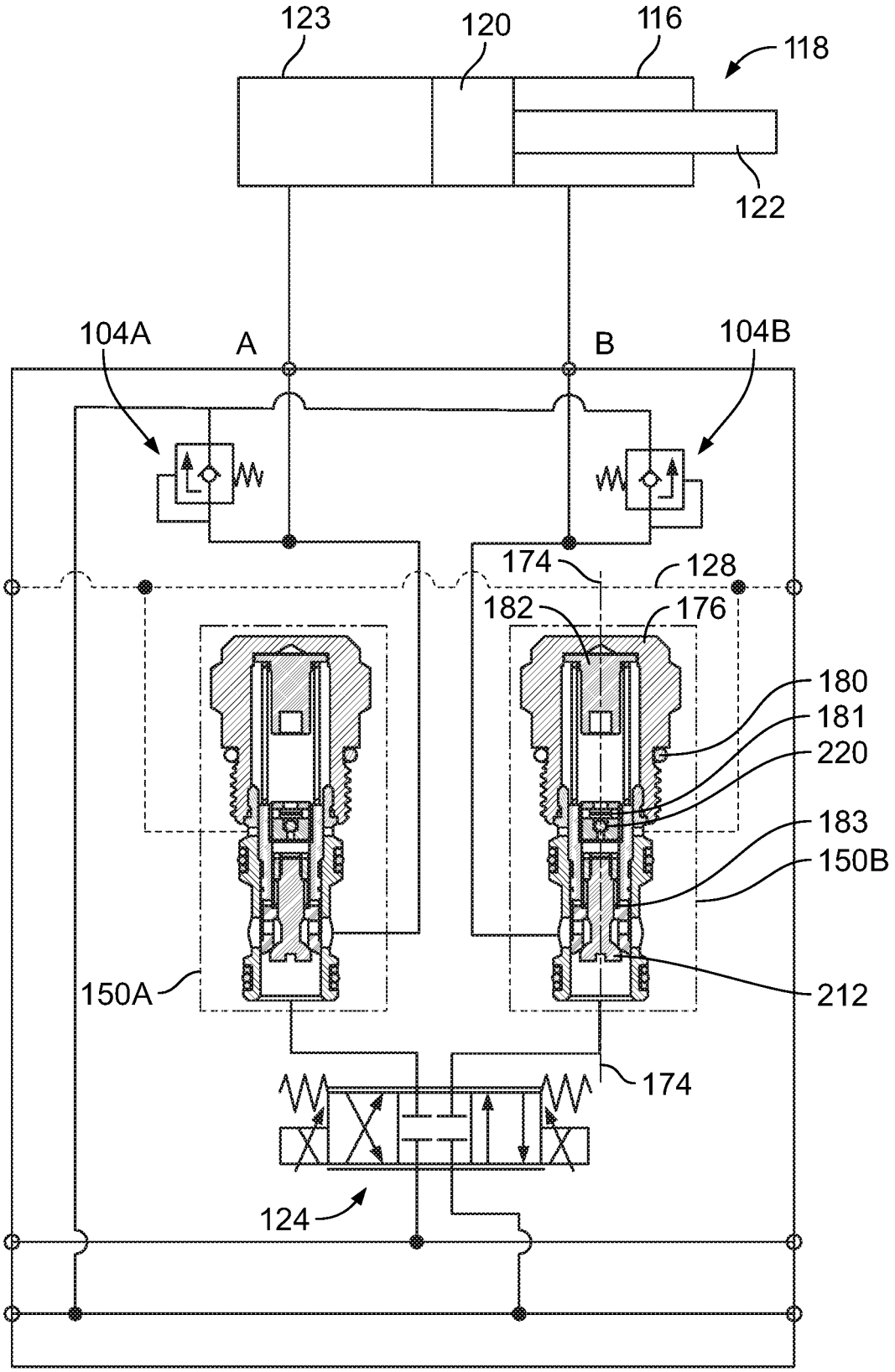
FIG. 3 depicts axial cross-sections of example structures of the compensator units of FIG. 2, including additional schematically represented portions of the hydraulic system of FIG. 2.

Referring now to FIGS. 2-3, hydraulic compensator units and associated hydraulic systems having one or more advantages over the system and hydraulic arrangement of FIG. 1 will now be described.

Referring specifically to FIG. 2, a hydraulic system 108 according to the present disclosure is schematically depicted, the hydraulic system 108 including pressure compensator units 150A, 150B according to the present disclosure.

A variable displacement pump 110 is in fluid communication with a tank 112, includes a swash plate 114, and is adapted to charge a hydraulic actuator 116 via first and second actuator ports A and B. The hydraulic actuator 116 is adapted to perform work on a load. In this example, the hydraulic actuator 116 is a cylinder and includes a piston 118 having a piston head 120 and a piston shaft 122. The piston shaft 122 moves axially within a cylinder body 123. In other examples the actuator can be of another type, e.g., a motor.

A three position closed-center valve 124 (e.g., a three-position spool valve) determines which of the actuator ports A, B is in fluid communication with the variable displacement pump 110, and which is in fluid communication with tank 126. In the depicted lefthand position 127 of the valve 124, the port B is on the high pressure side of the cylinder 116 and is in fluid communication with the pump 110, and the port A is on the low pressure side of the cylinder 116 and is in fluid communication with tank 126. When the three-position valve 125 is in the righthand position 129, the port A is on the high pressure side of the cylinder 116 and is in fluid communication with the pump 110, and the port B is on the low pressure side of the cylinder 116 and is in fluid communication with tank 126. When the three-position valve 124 is in the center position 125, the ports of the three-position valve 124 are blocked such that the cylinder ports A, B as well as the valve ports of the valve 124 are not in fluid communication with (i.e., are blocked from fluid communication with) either the pump 110 or tank 26.

Thus, the three-position valve 124 determines which of the actuator ports A, B is in fluid communication with the pump 110, which is in fluid communication with tank 126, or whether the hydraulic system is idle, i.e., neither of the actuator ports is in fluid communication with the pump 110.

In some examples, the position of the valve 124 is determined by a control command, input, e.g., via an operator interface on a piece of hydraulic equipment. For example, if an operator moves a joystick in one direction away from neutral for forward motion, the three-position valve shifts to, or remains in, the position 127, where the port B is in fluid communication with, and can be charged by, the pump 110 and the port A is in fluid communication with tank 126. If the operator moves the joystick in the opposite direction away from neutral for reverse motion, the three-position valve 124 shifts to the position 129, where the port B is in fluid communication with tank 126, and the port A is in fluid communication with, and can be charged by, the pump 110. If the operator moves the joystick to neutral, the three-position valve moves to the position 125, where neither port A, B is in fluid communication with the pump 110 or the tank 126.

Each of the ports A, B is in fluid communication with a corresponding relief valve 4A, 4B, which selectively opens and closes to a pressure relief line 40. In the event of an overload condition when, e.g., the three-position valve 124 is in the center position 125, overload pressure in the actuator 116 can be relieved via the appropriate relief valve 104A, 104B to tank 131.

The compensator arrangement 109 is adapted to sense a load on the actuator 116 and provide a pressure balanced or pressure compensated hydraulic signal corresponding to the sensed load to a pump adjustment system 130. The response of the adjustment system 130 to the sensed load controls the position of the swash plate 114 via a pump control 132. In this example, the pump control 132 includes a cylinder 133 with a spring-loaded piston 135. Sufficiently high pressure from the adjustment system 130 via a shuttle valve 141 and the adjustment line 139 acts to axially move the piston 135 against the spring 137 to de-stroke the pump by shifting the swash plate 114 to a position of lower displacement. As the pressure in the compensation line 139 decreases again, the piston 135 automatically shifts to the left by the biasing force of the spring 133, returning the swash plate 114 to a position of maximum displacement by the pump 110.

Figure 4:
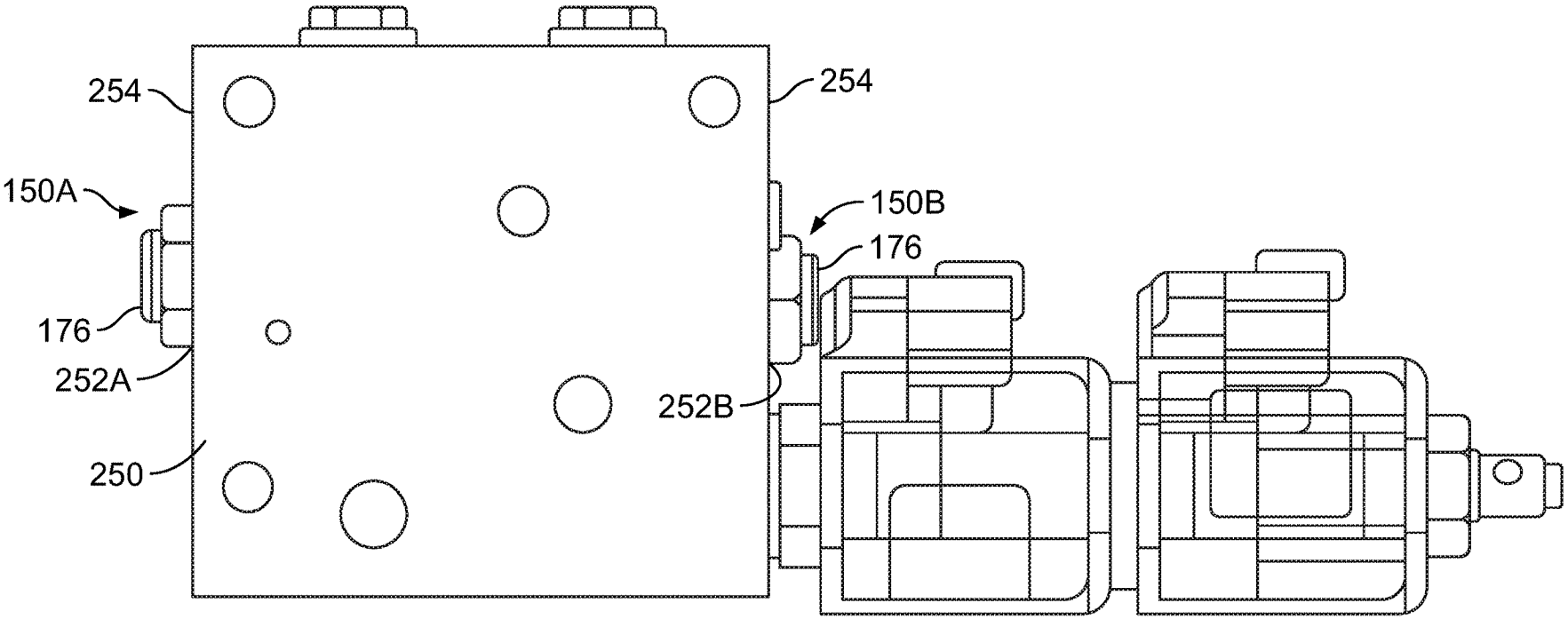
FIG. 4 is a schematic side view of an embodiment of a system including two pressure compensator units according to the present disclosure mounted to, and plugging ports in, a valve block.
Figure 5:
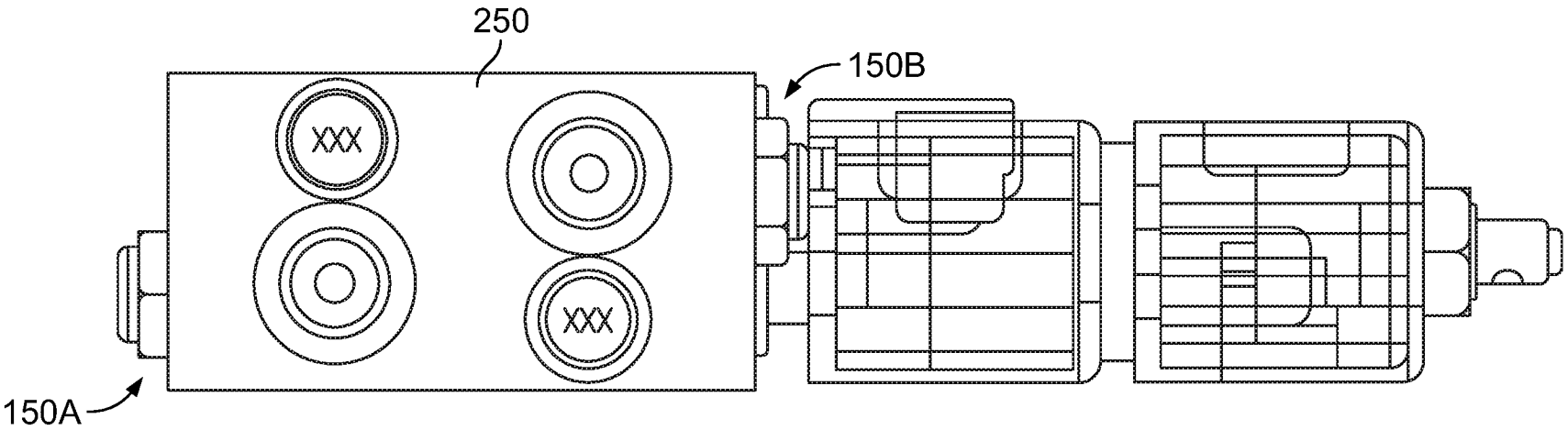
FIG. 5 is a schematic end view of the system of FIG. 4.
Figure 6:
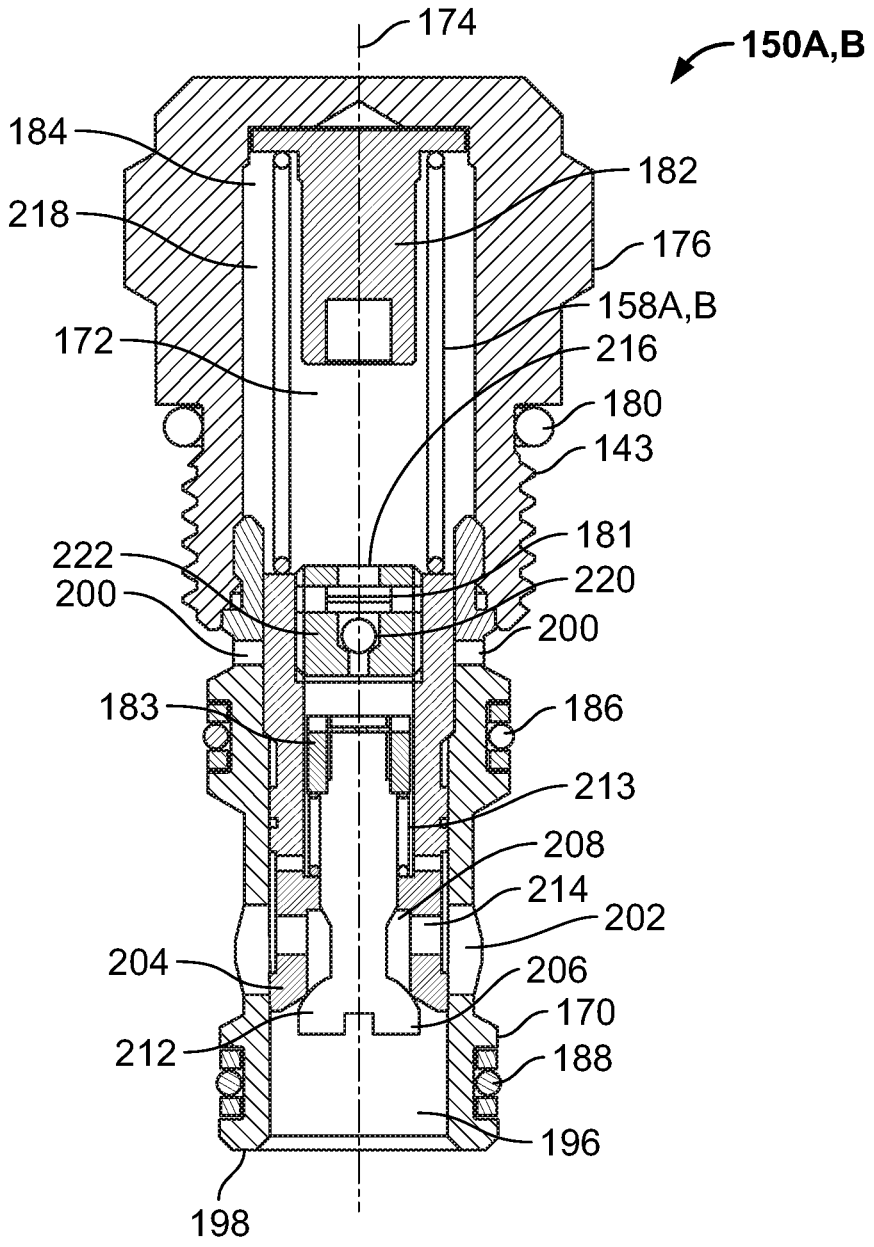
FIG. 6 is a cross-sectional view of one of the pressure compensator units of FIG. 3.
Figure 7:
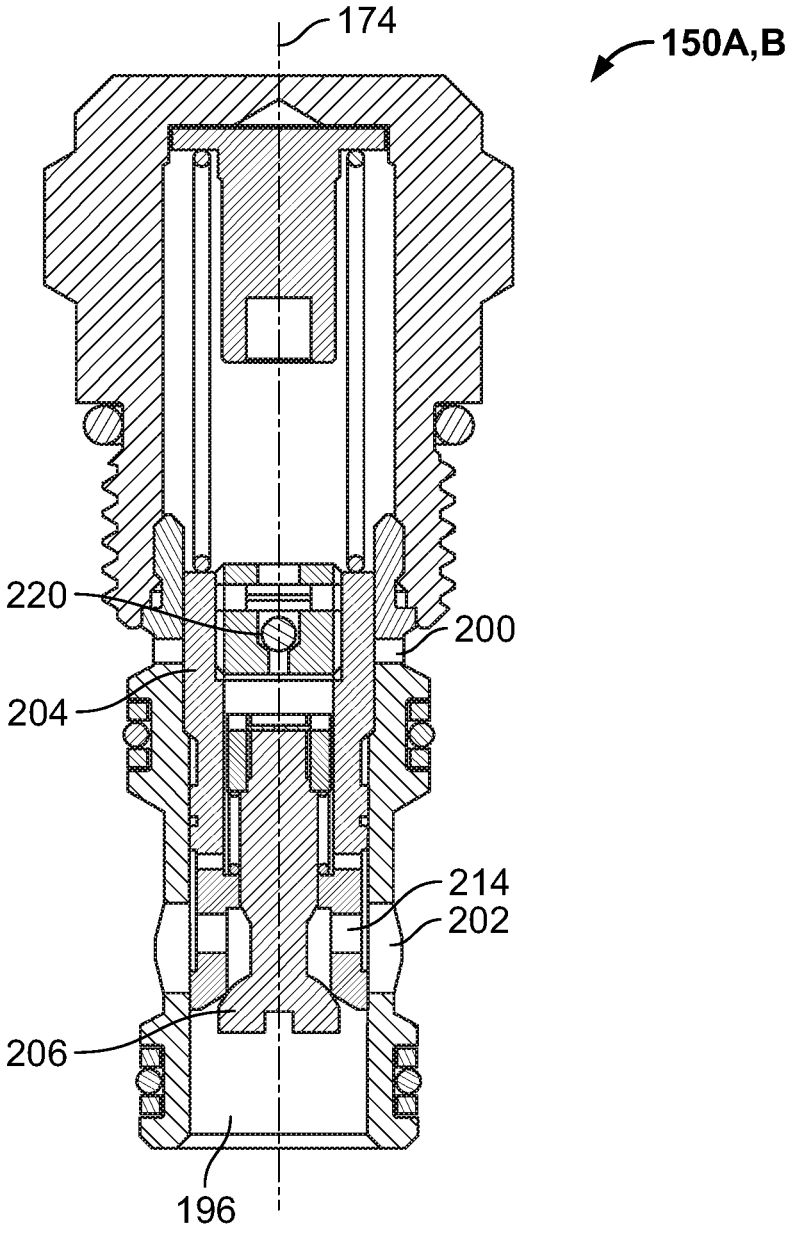
FIG. 7 is a cross-sectional view of one of the pressure compensator units of FIG. 3, indicating certain functional characteristics of structure features of the pressure compensator unit.

The pressure compensator unit 150A includes an input port 152A, a reverse flow check 154A, a pressure compensation valve 156A having a spring 158A, a load sense check 160A, an actuator line output port 162A, and a load sense line output port 164A. A dedicated main body 166A of the pressure compensator unit 150A at least partially defines or houses each of the input port 152A, the reverse flow check 154A, the pressure compensation valve 156A with spring 158A, the load sense check 160A, the actuator line output port 162A, and the load sense line output port 164A such that the pressure compensator unit 150A is configured as a unitary plug-like component that can be inserted into a port 252A of a valve block 250 (FIGS. 4-5).

Similarly, the pressure compensator unit 150B includes an input port 152B, a reverse flow check 154B, a pressure compensation valve 156B having a spring 158B, a load sense check 160B, an actuator line output port 162B, and a load sense line output port 164B. A dedicated main body 166B of the pressure compensator unit 150B at least partially defines or houses each of the input port 152B, the reverse flow check 154B, the pressure compensation valve 156B with spring 158B, the load sense check 160B, the actuator line output port 162B, and the load sense line output port 164B such that the pressure compensator unit 150B is configured as a unitary plug-like component that can be inserted into a port 252B of a valve block 250 (FIGS. 4-5).

With the three-position valve 124 in the position shown in FIG. 2, when pressure from the pump 110 is applied to the input port 152B of the pressure compensator unit 150B, the reverse flow check valve 154B prevents flow from moving through the unit directly to port B. Instead, the pump pressure acts on the right side 168B of the pressure compensation valve 156B of the unit 150B, thereby forcing the valve member of the pressure compensation valve 156B to the left against the biasing spring 158B to an open position where pump pressure is placed in fluid communication with the port B of the hydraulic cylinder 116. Concurrently, the load sense check 160B of the unit 150B is forced open, thereby allowing pump pressure to be applied against the left side of the valve member of the pressure compensation valve 156B, thereby providing pressure balancing, pressure compensation, and/or valve modulation with respect to the pressure compensator unit 150B itself.

When the load sense check 160B is opened, the pump pressure is also placed in fluid communication with the adjustment system 130 through the load sense line 128. At the same time, the pump pressure is applied against the load sense check 160A of the left pressure compensator unit 150A to hold it closed.

As hydraulic pressure and flow are applied to the hydraulic cylinder 116 through the port B, hydraulic fluid is expelled from the port A and flows through the pressure compensator unit 150A through the reverse flow check valve 154A to tank 126 via tank line 119. The valve member of the pressure compensation valve 156A of the pressure compensator unit 150A remains in a closed position (e.g., via pressure from the spring 158A on the right end 159A of the valve 156A as well as the load sense line 128 pressure acting on the right end 159A of the valve 156A) as flow proceeds through the reverse flow check valve 154A. Thus, aside from brief transitional periods when the three-position valve 124 is shifting from one position to another, only one of the load sense checks 160A, 160B is open to the load sense line 128 at a time.

With the three-position valve 124 in the right hand position (not shown), when pressure from the pump 110 is applied to the input port 152A of the pressure compensator unit 150A, the reverse flow check valve 154A prevents flow from moving through the unit directly to port A. Instead, the pump pressure acts on the right side 168A of the pressure compensation valve 156A of the unit 150A, thereby forcing the valve member of the pressure compensation valve 156A to the left against the biasing spring 158A to an open position where pump pressure is placed in fluid communication with the port A of the hydraulic cylinder 116. Concurrently, the load sense check 160A of the unit 150A is forced open, thereby allowing pump pressure to be applied against the left side of the valve member of the pressure compensation valve 156A, thereby providing pressure balancing, pressure compensation, and/or valve modulation with respect to the pressure compensator unit 150A itself.

When the load sense check 160A is opened, the pump pressure is also placed in fluid communication with the adjustment system 130 through the load sense line 128. At the same time, the pump pressure is applied against the load sense check 160B of the left pressure compensator unit 150B to hold it closed.

As hydraulic pressure and flow are applied to the hydraulic cylinder 116 through the port A, hydraulic fluid is expelled from the port B and flows through the pressure compensator unit 150B through the reverse flow check valve 154B to tank 126. The valve member of the pressure compensation valve 156B of the pressure compensator unit 150B remains in a closed position (e.g., via pressure from the spring 158B on the left end 159B of the valve 156B as well as the load sense line 128 pressure acting on the left end 159B of the valve 156B) as flow proceeds through the reverse flow check valve 154B. Thus, as described above, aside from brief transitional periods, only one of the load sense checks 160A, 160B is open to the load sense line 128 at a time.

Referring now to FIGS. 3, and 6-8 an example structural configuration of one of the pressure compensator units 150B will be described. It should be appreciated that the structural configuration of the pressure compensator unit 150A can be, at least in some examples, identical to the structural configuration of the pressure compensator unit 150B.

The pressure compensator unit 150B includes a main valve body 170 defining a central passage 172 that extends along a central axis 174. The upper end of the central passage of the main valve body 170 is closed by a cap 176 that screwingly threads on the upper end of the main valve body 170 with complementary screw threads/grooves 178. The cap 176 carries a first outer annular seal 180 (e.g., an O-ring) in a plane perpendicular to the central axis 174 for sealing against a wall of a unit receiver of a valve block 250 (FIGS. 4-5) when the compensator unit 150B is mounted within its corresponding port 252B (FIGS. 4-5) of the valve block 250. The cap 176 also secures a spring seat 182 at the upper end of the central passage 172, the spring seat 182 being partially received in an axially extending recess 184 defined by the cap 176. When fully mounted, the cap 176 protrudes exteriorly beyond an exterior surface 254 of the valve block 250 (FIGS. 4-5). In some examples, the cap 176 is configured with screw threads 143 that threadably engage corresponding threads on the wall of the unit receiver defined by the valve block 250 (FIGS. 4-5). Thus, due to the cap 176, the pressure compensator unit 150B is configured as a plug adapted to be inserted as a unit into a unit receiver defined by the valve block 250 (FIGS. 4-5) with a portion of the cap 176 acting as a plug head sized to be larger than a corresponding dimension of the unit receiver.

The pressure compensator unit 150B also includes second and third annular seals 186, 188 (e.g., O-rings) mounted on the main valve body 170 in planes perpendicular to the central axis 174. The seals 186, 188 are centered about the central axis 174 and the second seal 186 is positioned axially between the first and third seals 180 and 188. When the pressure compensator unit 150B is mounted within its corresponding port 252A, 252B of the valve block 250 (FIGS. 4-5), a first annular chamber 190 is defined outside the main valve body 170 between the main valve body and the valve block and axially between the first and second seals 180 and 186 and centered about the central axis 174, a separate second annular chamber 192 is defined outside the main valve body 170 between the main valve body and the valve block and axially between the second and third seals 186 and 188 centered about the central axis 174, and a separate end chamber 194 is defined at the lower end 198 of the main valve body 170.

When the pressure compensator unit 150B is mounted in the valve block 250 (FIG. 4-5), the first annular chamber 190 is in fluid communication with the load sense line 128, the second annular chamber 192 is in fluid communication with the hydraulic cylinder port B corresponding the unit 150B, and the end chamber 194 is in fluid communication with either pump output pressure from the pump 110 (FIG. 2) or tank 126 (FIG. 2) depending upon the position of the three-position valve 124 (FIG. 2).

The main valve body 170 defines a lower end opening 196 in fluid communication with the end chamber 194, at least one first side opening 200 in fluid communication with the first annular chamber 190, and at least one second side opening 202 in fluid communication with the second annular chamber 192. The openings 200, 202 provide fluid communication with the central passage 172 of the main valve body.

The pressure compensator unit 150B further includes a compensation valve member 204 mounted to move axially within the central passage 172 of the main valve body 170, and a reverse check poppet 206 mounted to move axially within a lower end of a central passage 208 of the compensation valve member 204.

The compensation valve member 204 has a lower end opening 210. A head 212 of the reverse check poppet 206 controls whether the lower end opening 210 of the compensation valve member 204 is open or closed. When the reverse check poppet 206 is in a first axial position (e.g., a closed position) relative to the compensation valve member 204, the lower end opening 210 of the compensation valve member 204 blocks fluid communication between the lower end chamber 194 and the central passage 208 of the compensation valve member 204 through the lower opening 210 of the compensation valve member 204. When the reverse check poppet 206 is in a second axial position (e.g., an open position) relative to the compensation valve member 204, the lower end opening 210 of the compensation valve member 204 provides fluid communication between the lower end chamber 194 and the central passage 208 of the compensation valve member 204 through the lower end opening 210 of the compensation valve member 204. A stopper 183 coupled to the valve member 204 prevents the check poppet 206 from escaping the central passage 208 of the valve member 204 when the check poppet 206 is in the open (i.e., second axial) position. A reverse check spring 213 axially biases the compensation valve member 204 toward the first axial position of the compensation valve member 204 relative to the reverse check poppet 206.

The compensation valve member 204 also defines at least one side opening 214 just above the lower end opening 210, which provides fluid communication between the second annular chamber 192 and the central passage 208 of the compensation valve member 204.

The compensation valve member 204 is movable between the first axial position (e.g., a closed position) and the second axial position (e.g., an open position). The main spring 158B is adapted to provide an axial spring force that is stronger than the axial spring force with which the reverse check spring 213 axially biases the compensation valve member 204 toward the first axial position.

When the compensation valve member 204 is in the first position relative to the main valve body 170 and the reverse check poppet 206 is in the first position relative to the compensation valve member 204, fluid communication is blocked between the lower end chamber 194 and the second annular chamber 192. When the compensation valve member 204 is in the second position relative to the main valve body 170 or the reverse check poppet 206 is in the second position relative to the compensation valve member 204, fluid communication is open between the lower end chamber 194 and the second annular chamber 192.

The compensation valve member 204 also includes a top opening 216 that provides fluid communication between the central passage 208 of the compensation valve member 204 and a spring chamber 218 defined within the central passage 172 of the main valve body 107. The first side opening 200 of the main valve body 170 provides fluid communication between the first annular chamber 190 and the spring chamber 218. A load sense check ball 220 seats upon a check ball seat 222 defined within the central passage 208 of the compensation valve member 204 between the top opening 216 and the side opening 214 of the compensation valve member 204. A retaining pin 181 coupled to the valve member 204 prevents the load sense check ball 220 from escaping the central passage 208 of the valve member 204 when the check ball 220 is moved off its seat 222.

When pump pressure (e.g., from the pump 110 (FIG. 2)) is coupled to the end chamber 194, the pump pressure acts on the lower end of the compensation valve member 204 thereby forcing the compensation valve member 204 to the open position against the bias of the main compensation spring 158B while also keeping the reverse check poppet 206 in the closed position. With the compensation valve member 204 in the open position, pump pressure is provided to the port B of the hydraulic cylinder and is also provided to the central passage 208 of the compensation valve member 204 via the second side opening 202 of the main valve body 170 and the side opening 214 of the compensation valve member 204. In addition, the pump pressure in the central passage 208 of the compensation valve member 204 forces the load sense check ball 220 (of the load sense check 160B (FIG. 2)) to an open position such that the spring chamber 218 and the load sense line 128 are pressurized via pump output pressure. The pump pressure in the spring chamber 218 along with the spring force of the main compensation spring 158B act on the top end of the compensation valve member 204 to provide pressure compensation.

When tank 126 (FIG. 2) is coupled to the end volume 194, fluid pressure from the corresponding port B of the hydraulic cylinder 116 is communicated to a top side of the head 212 of the reverse check poppet 206 through the second side opening 202 of the main valve body 170 and the side opening 214 of the compensation valve member 204. The pressure forces the reverse check poppet 206 to open (e.g., the head 212 displaces from its seat 224 defined by the lower end of the compensation valve member 204) to allow the fluid discharged from the hydraulic cylinder 116 via the port B to flow to tank 126 (FIG. 2) through the lower end 198 of the main valve body 170 via the lower end opening 196.

Figure 8C:
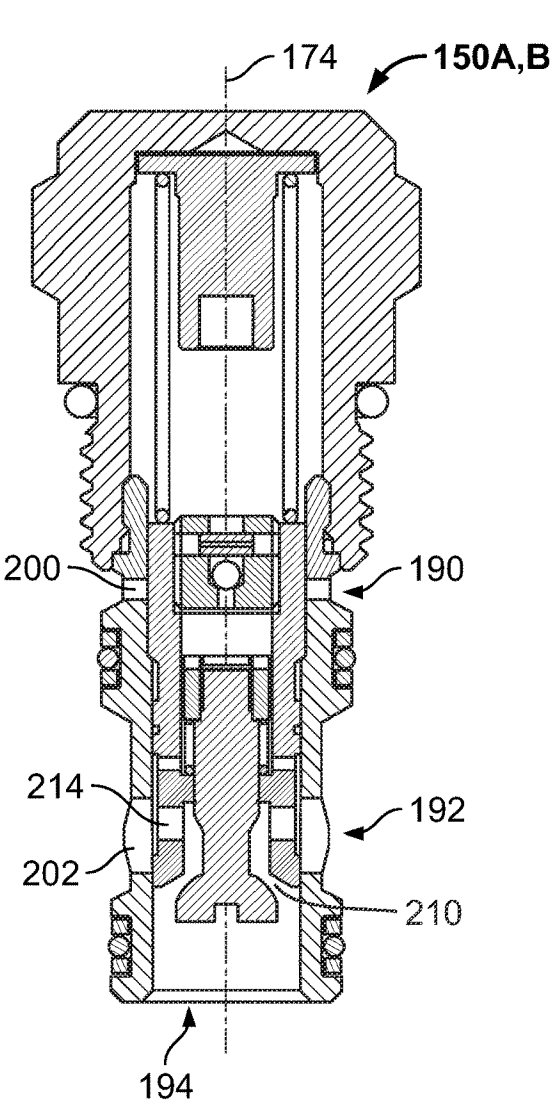
FIG. 8C is a cross-sectional view of one of the pressure compensator units of FIG. 3 depicted in a third operating mode.
Figure 8B:
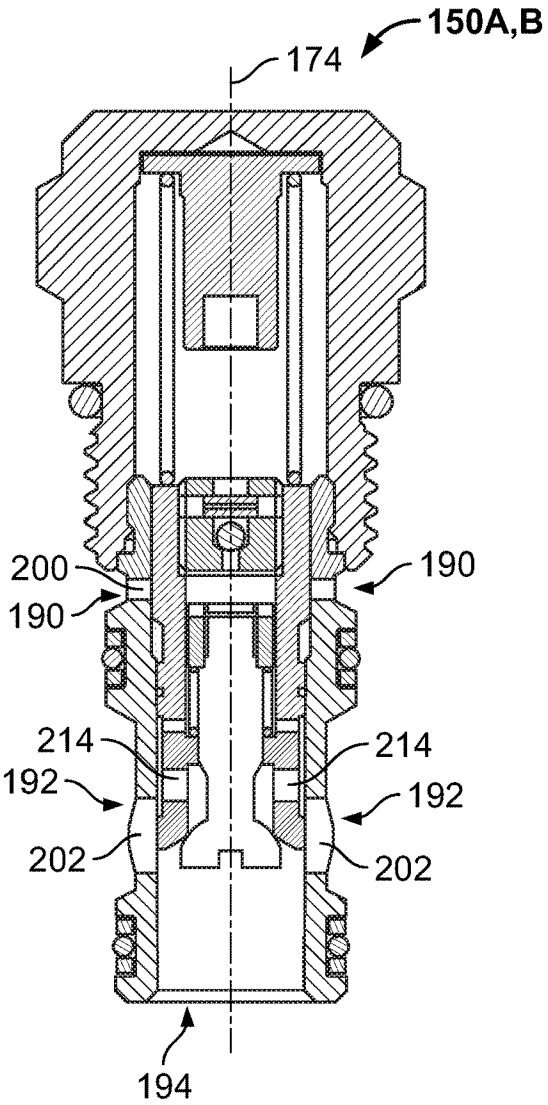
FIG. 8B is a cross-sectional view of one of the pressure compensator units of FIG. 3 depicted in a second operating mode.
Figure 8A:
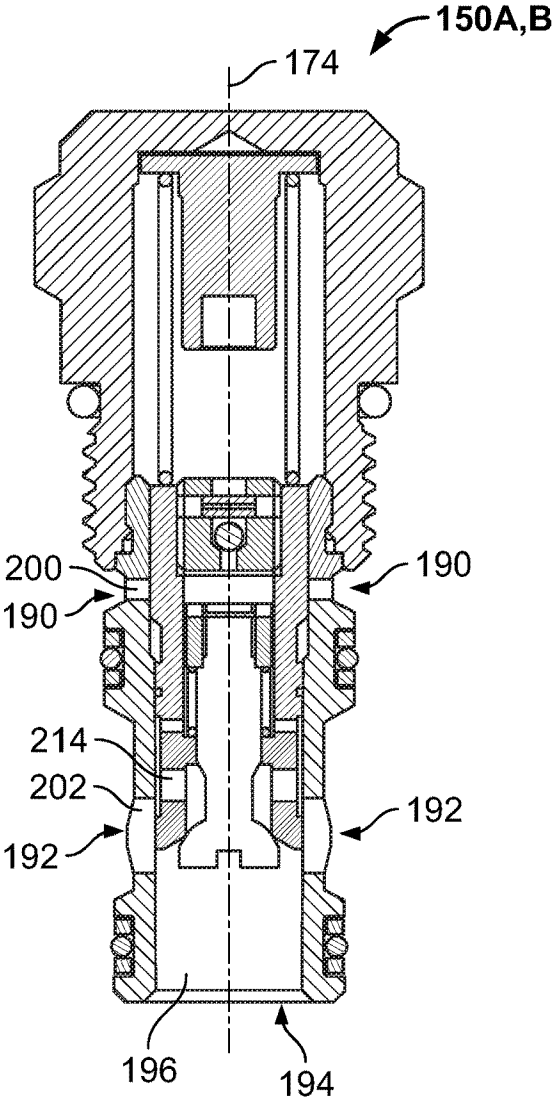
FIG. 8A is a cross-sectional view of one of the pressure compensator units of FIG. 3 depicted in a first operating mode.

Referring to FIGS. 8A-8C, modes of the pressure compensation unit 150A, 150B are depicted that provide different fluid flows through the compensation unit 150A, 150B. In FIG. 8A, the compensation unit 150A, 150B provides for pressure compensation and flow sharing. In FIG. 8B, the compensation unit 150A, 150B provides a load sense signal (e.g., to the adjustment system 130 (FIG. 2)). In FIG. 8C, the compensation unit 150A, 150B is in a mode that permits reverse flow from the load to tank.

Referring to FIGS. 4-5, due to the component integration provided by the pressure compensator units 150A, 150B of the present disclosure, in at least some examples the overall dimensions of the valve block 250 are smaller than required for a valve block that receives the compensator arrangements 9 of FIG. 1. In addition, the number of receivers defined by the valve block 250 is less than required for a valve block that receives the compensator arrangements 9 of FIG. 1. Thus, it can be appreciated that the pressure compensator units of the present disclosure and the systems containing them can take up less space, be of lighter weight, and/or be easier to assemble or disassemble as compared with prior art pressure compensation arrangements and associated systems.

Example Embodiments

According to first example embodiment of the present disclosure there is a provided a hydraulic system comprising: a hydraulic actuator; a variable displacement pump in selective fluid communication with a first port of the hydraulic actuator and in selective fluid communication with a second port of the hydraulic actuator; a load sense line; a tank line; a pump adjustment system; a pump control operatively coupled to the pump adjustment system and a swash plate of the pump; and first and second hydraulic pressure compensator units, each of the compensator units comprising: a main valve body defining a central axis and a first central passage; a compensation valve member positioned in the first central passage and defining a second central passage, a first opening defined by the main valve body adapted to be in selective fluid communication with one of the first and second ports of the hydraulic actuator via a second opening defined by the main valve body to selectively provide pump pressure to the first or second port of the hydraulic actuator; a load sense check component positioned within the second central passage and adapted to move axially relative to the compensation valve member between a load sense open position and a load sense closed position, the load sense open position being in a first axial direction away from the load sense closed position, wherein in the load sense open position the first opening is adapted to be in fluid communication with the load sense line via a third opening defined by the main valve body to provide pump pressure to the load sense line, and wherein in the load sense closed position the first opening is adapted to be blocked from fluid communication with the load sense line; and a reverse flow check component positioned within the second central passage and adapted to move axially relative to the compensation valve member between a reverse flow open position and a reverse flow closed position, the reverse flow open position being in a second axial direction away from the reverse flow closed position, the second axial direction being opposite the first axial direction, wherein in the reverse flow open position the second opening is adapted to be in fluid communication with the tank line via the first opening, and wherein in the reverse flow closed position the second opening is adapted to be blocked from fluid communication with the tank line.

According to a second example embodiment, there is provided the first example embodiment, wherein for each of the first and second hydraulic pressure compensator units: the first opening is adapted to be in fluid communication with the first or the second port of the hydraulic actuator when the compensation valve member is in an actuator open position relative to the main valve body or when the reverse flow check component is in the reverse flow open position; the first opening is adapted to be blocked from fluid communication with the first or the second port of the hydraulic actuator when the compensation valve member is in an actuator closed position relative to the main valve body and the reverse flow check component is in the reverse flow closed position; and relative to the main valve body, in the actuator open position the compensation valve member is axially displaced in the first axial direction from the actuator closed position/

According a third example embodiment, there is provided the first or second example embodiment, wherein the first hydraulic pressure compensator unit is adapted to provide selective fluid communication between the pump and the first port of the hydraulic actuator but not the second port of the hydraulic actuator, and wherein the second hydraulic compensator unit is adapted to provide selective fluid communication between the pump and the second port of the hydraulic actuator but not the first port of the hydraulic actuator.

According to a fourth example embodiment, there is provided the third example embodiment, further comprising a three-position closed center flow control valve adapted to control fluid communication between the pump and each of the first and second hydraulic compensator units.

According to a fifth example embodiment, there is provided any of the first through fourth example embodiments, wherein the hydraulic actuator is a hydraulic cylinder.

According to a fifth example embodiment, there is provided any of the first through fourth example embodiments, wherein the hydraulic actuator is a motor.

According to a sixth example embodiment, there is provided any of the first through fifth example embodiments, further comprising at least one of a mobile crane, a loader, an excavator, a drill, a tractor, and a telehandler.

According to a seventh example embodiment, there is provided any of the first through sixth example embodiments, further comprising a valve block, the valve block defining first and second ports in which the first and second hydraulic pressure compensator units are mounted to define at least first, second, and third chambers between each of the main valve bodies and the valve block, at least two of the first and second third chambers defining annular spaces.

According to an eighth example embodiment, there is provided the seventh example embodiment, wherein each of the first and second hydraulic pressure compensator units comprises an end cap protruding exteriorly from an exterior surface of the valve block.

According to a ninth example embodiment, there is provided the eighth example embodiment, wherein the cap protrudes exteriorly from an exterior surface of the valve block, and wherein the hydraulic compensator unit is threadably mounted in the port of the valve block.

The various examples described above are provided by way of illustration only and should not be construed to limit the scope of the present disclosure. Those skilled in the art will readily recognize various modifications and changes that may be made without following the example examples and applications illustrated and described herein, and without departing from the true spirit and scope of the present disclosure.

What is claimed is:

1. A hydraulic pressure compensator unit comprising:

a main valve body defining a central axis and a first central passage;

a compensation valve member positioned in the first central passage and defining a second central passage, a first opening defined by the main valve body adapted to be in selective fluid communication with a port of a hydraulic actuator via a second opening defined by the main valve body;

a load sense check component positioned within the second central passage and adapted to move axially relative to the compensation valve member between a load sense open position and a load sense closed position, the load sense open position being in a first axial direction away from the load sense closed position, wherein in the load sense open position the first opening is adapted to be in fluid communication with a load sense line via a third opening defined by the main valve body, and wherein in the load sense closed position the first opening is adapted to be blocked from fluid communication with the load sense line; and a reverse flow check component positioned within the second central passage and adapted to move axially relative to the compensation valve member between a reverse flow open position and a reverse flow closed position, the reverse flow open position being in a second axial direction away from the reverse flow closed position, the second axial direction being opposite the first axial direction, wherein in the reverse flow open position the second opening is adapted to be in fluid communication with a tank line via the first opening, and wherein in the reverse flow closed position the second opening is adapted to be blocked from fluid communication with the tank line.

2. The hydraulic pressure compensator unit of claim 1, wherein the first opening is adapted to be in fluid communication with the port of the hydraulic actuator when the compensation valve member is in an actuator open position relative to the main valve body or when the reverse flow check component is in the reverse flow open position, wherein the first opening is adapted to be blocked from fluid communication with the port of the hydraulic actuator when the compensation valve member is in an actuator closed position relative to the main valve body and the reverse flow check component is in the reverse flow closed position, and wherein, relative to the main valve body, in the actuator open position the compensation valve member is axially displaced in the first axial direction from the actuator closed position.

3. The hydraulic pressure compensator unit of claim 2, further comprising a first axial biasing element positioned within the first central passage and operatively coupled to the compensation valve member to bias the compensation valve member toward the second axial direction and toward the actuator closed position.

4. The hydraulic pressure compensator unit of claim 3, wherein the first axial biasing element is a spring.

5. The hydraulic pressure compensator unit of claim 4, further comprising a spring seat received in a recess defined by a cap, the cap being coupled to and covering an axial end of the main valve body.

6. The hydraulic pressure compensator unit of claim 1, wherein the reverse flow check component comprises a poppet and a second axial biasing element positioned within the second central passage and operatively coupled to the compensation valve member to bias the compensation valve member toward the reverse flow closed position.

7. The hydraulic pressure compensator unit of claim 1, wherein the load sense check component comprises a check ball, wherein the compensation valve member defines a check ball seat, wherein the check ball is seated on the check ball seat when the load sense check component is in the load sense closed position, and wherein the check ball is axially displaced in the first axial direction from the check ball seat when the load sense check component is in the load sense open position.

8. The hydraulic pressure compensator unit of claim 1, wherein the reverse flow check component comprises a poppet having a head, wherein the head engages an axial end of the compensation valve member when the reverse flow check component is in the reverse flow closed position, and wherein the head is axially displaced in the second axial direction from the axial end of the compensation valve member when the reverse flow check component is in the reverse flow open position.

9. The hydraulic pressure compensator unit of claim 1, further comprising a plurality of seals positioned on an outer surface of the main valve body or an outer surface of the cap and surrounding the central axis, the plurality of seals defining a plurality of regions.

10. The hydraulic pressure compensator unit of claim 9, wherein each of the plurality regions defines a chamber when the main valve body is coupled to a valve block.

11. The hydraulic pressure compensator unit of claim 10, wherein a first of the plurality of chambers defines a first annular space axially positioned between a first of the seals and a second of the seals;

wherein the first chamber is adapted to be in fluid communication with the first opening via the third opening when the load sense check component is in the load sense open position;

wherein the first chamber is adapted to be blocked from fluid communication with the first opening when the load sense check component is in the load sense closed position;

wherein a second of the plurality of chambers defines a second annular space axially positioned between the second of the seals and a third of the seals, the second of the seals being axially positioned between the first and second seals;

wherein the second chamber is adapted to be in fluid communication with the first opening via the second opening when the compensation valve member is in the actuator open position and/or when the reverse flow check component is in the reverse flow open position; and wherein the second chamber is adapted to be blocked from fluid communication with the first opening when the compensation valve member is in the actuator closed position and the reverse flow check component is in the reverse flow closed position.

12. The hydraulic pressure compensator unit of claim 11, wherein each of the plurality of seals comprises an O-ring.

13. A system comprising the hydraulic pressure compensator unit of claim 9 and a valve block, the valve block defining a port in which the hydraulic pressure compensator unit is mounted to define a first chamber between the main valve body and the valve block and axially positioned between a first and a second of the seals and a second chamber between the main valve body and the valve block and axially positioned between the second and third of the seals, the second of the seals being positioned axially between the first and third seals.

14. The hydraulic pressure compensator unit of claim 1, wherein the hydraulic actuator is a hydraulic cylinder.

15. The hydraulic pressure compensator unit of claim 1, wherein the hydraulic actuator is a motor.

16. A system comprising at least a first and a second of the hydraulic pressure compensator units of claim 1, wherein the first hydraulic pressure compensator unit is in selective fluid communication with a first port but not a second port of the hydraulic actuator, and wherein the second hydraulic pressure compensator unit is in selective fluid communication with the second port but not the first port of the hydraulic actuator.

17. The hydraulic pressure compensator unit of claim 1, wherein the hydraulic pressure compensator unit is configured as a plug to plug a port defined by a valve block such that a cap of the hydraulic pressure compensator unit protrudes exteriorly from an exterior surface of the valve block.

18. A multi-functional valve unit comprising:

a valve arrangement configured to be installed in a valve block as a unit, the valve arrangement being configured to permit fluid flow in a forward direction through the valve arrangement from a first location to a second location, the valve arrangement also being configured to permit fluid to flow in a reverse direction through the valve arrangement from the second location to the first location, the valve arrangement including:

a pressure compensated flow control valve configured to maintain a constant pressure drop with respect to fluid flowing in the forward direction through the valve arrangement, wherein fluid is prevented from flowing through the pressure compensated flow control valve in the reverse direction through the valve arrangement;

a reverse flow check valve positioned along a flow path that bypasses the pressure compensated flow control valve, the reverse flow check valve being configured to allow fluid flowing in the reverse direction through the valve arrangement to flow through the flow path and bypass the pressure compensated flow control valve, and the reverse flow check valve being configured to prevent fluid flowing in the forward direction through the valve arrangement to bypass the pressure compensated flow control valve through the flow path; and a load sense check valve in fluid communication with the second location, wherein the load sense check valve opens when fluid flows in a forward direction through the valve arrangement.

19. The multi-functional valve unit of claim 18, wherein the pressure compensated flow control valve includes a valve member moveable between an open position and a closed position, wherein the valve member includes a first end acted on by fluid pressure corresponding to the first location to force the valve member toward the open position, wherein the valve member includes a second end acted on by fluid pressure corresponding to the second location to force the valve member toward the closed position when the load sense check valve is open, and wherein a spring also acts on the second end to bias the valve member toward the closed position.

20. The multi-functional valve unit of claim 19, wherein the load sense check valve comprises a load sense ball that moves between a load sense closed position and a load sense open position, wherein in the load sense closed position the load sense ball rests on a load sense seat defined by the valve member, and wherein in the load sense open position the load sense ball is axially displaced from the load sense seat.

21. The multi-functional valve unit of claim 20, wherein the reverse flow check valve comprises a poppet that moves between a reverse flow closed position and a reverse flow open position, wherein in the reverse flow closed position a head of the poppet rests against the second end of the valve member and wherein in the reverse flow open position the head of the poppet is axially displaced from the second end of the valve member.

22. The multi-functional valve unit of claim 21, wherein the axial displacement of the poppet is in an opposite direction from the axial displacement of the load sense ball.

23. The multi-functional valve unit of claim 22, further comprising first, second and third seals, the first and second seals defining a first flow chamber at least partially surrounding the valve unit and in communication with the first side opening, and the second and third seals defining a second flow chamber at least partially surrounding the valve unit and in communication with the second side opening, the first and second flow chambers being sealed off from each other.

24. The multi-functional valve unit of claim 19, wherein the spring is a first spring, and the valve unit further comprises a second spring that axially biases the valve member toward a position in which the reverse flow check valve is closed.

25. The multi-functional valve unit of claim 18, wherein the valve arrangement includes a main valve body having a central axis extending between a first and a second end opposite the first end, a cap secured to the main valve body at the second end of the main valve body and covering the second end of the main valve body, and wherein the first end of the main valve body is open.

26. The multi-functional valve unit of claim 25, wherein the main valve body defines at least one first side opening that is selectively openable to allow fluid to flow forwardly to a port of a hydraulic actuator, and at least one second side opening that is selectively openable to allow fluid to flow to a load sense line.

* * * * *